United States Patent [19]

Wunder

[11] Patent Number: 4,589,478

[45] Date of Patent: May 20, 1986

[54] PRESSURE PROTECTED TUBULAR HEAT EXCHANGER

[75] Inventor: John E. Wunder, Kettering, Ohio

[73] Assignee: United Aircraft Products, Inc., Dayton, Ohio

[21] Appl. No.: 766,512

[22] Filed: Aug. 19, 1985

[51] Int. Cl.[4] ..... F28F 9/02

[52] U.S. Cl. ..... 165/76; 165/134.1; 165/158; 165/917

[58] Field of Search ..... 165/134.1, 917, 76, 165/81, 158

[56] References Cited

U.S. PATENT DOCUMENTS

| | | | |
|---|---|---|---|
| 2,971,746 | 2/1961 | Bell | 165/134.1 |
| 3,583,479 | 6/1971 | Taylor | 165/134.1 |
| 3,924,675 | 12/1975 | Essebaggers | 165/134.1 |
| 4,029,145 | 6/1977 | Pfouts et al. | 165/161 |
| 4,265,301 | 5/1981 | Anderson | 165/162 |

*Primary Examiner*—Sheldon J. Richter
*Attorney, Agent, or Firm*—J. E. Beringer

[57] ABSTRACT

A heat exchanger of the tube and shell type comprising a shell and a shell enclosed tubular core, the core being removable from the shell for inspection and servicing. Motion of the core relative to the shell, and motion of core components relative to one another, is precluded without loss of core access and removability. In one disclosed form of the invention, abutments, at least one of which is part of a detachable closure, limit endwise core motion as well as a relative separating motion of headers which, together with interconnecting tubes, make up a core assembly. At the same time a rigid interponent element limits a relative approaching motion of the headers. In another disclosed form of the invention, headers have a screw threaded connection to parts of the enclosing shell.

7 Claims, 3 Drawing Figures

PRESSURE PROTECTED TUBULAR HEAT EXCHANGER

BACKGROUND OF THE INVENTION

1. Field of the Invention:

This invention relates to tubular heat exchangers and particularly to structural features thereof incorporating core removability with fluid pressure protection.

2. Description of the Prior Art:

In one type of tube and shell heat exchanger, a core assembly comprising spaced apart headers and interconnecting tubes is received in a shell body with provision being made for flow of a first fluid through the shell body over and around the core tubes and for flow of a second fluid through the tubes. Conventionally, metallurgical bonding is used to fix the core assembly in the shell body. This has the advantage of manufacturing simplicity and at the same time it seals the fluids from communication with one another.

In some instances, however, a heat exchanger user objects to metallurgical bonding on the ground that it effectively prevents heat exchanger disassembly and re-assembly, as for purposes of core inspection and servicing. In those instances there is substituted for metallurgical bonding a concept of O-ring sealing around header peripheries. An example of such alternate construction is shown in Pfouts, et al U.S. Pat. No. 4,029,145, dated June 14, 1977. As there indicated, header peripheries are slidably sealed to an interior wall of the shell body, and upon an end of the shell being opened up the core can be withdrawn for inspection.

What may be termed a floating core construction yields easy access to the core but is achieved at a cost of exposing core tubes and tube to header joints to potentially damaging fluid pressures. The fluids brought to the heat exchanger for heat transfer are circulated or supplied under pressure, which pressures are in some installations quite high. A high pressure fluid brought to an end of the core to flow through the tubes is applied in a manner to attempt a relative approaching motion of the headers. This effort is resisted by the tubes which are attached at their opposite ends to respective headers, as by brazing, mechanical expansion of the like. The applied pressure may be great enough to exceed the columnar strength of the tubes or the integrity of the tube to header joints. Similarly, fluid under pressure introduced between the headers for flow over and around the tubes exerts a force to urge a relative separating motion of the headers. Again, this is a pressure potentially destructive of tubes and tube to header joints.

Insofar as is known to those substantively involved in the preparation of this application, the problem of protecting against potentially damaging fluid pressures in tubular heat exchangers of the kind shown in the Pfouts, et al patent has not been dealt with prior to this invention.

SUMMARY OF THE INVENTION

The invention presents a tubular heat exchanger overcoming disadvantages and limitations of the known prior art. It relates to a heat exchanger of the tube and shell type comprising a core assembly made up of spaced apart headers and interconnecting tubes and comprising further a shell body receiving the core assembly and a separable closure for at least one end of the body. The shell body has an inlet and an outlet for a first fluid which is directed to flow between the headers over and around the tubes. A second fluid is admitted to the shell at one end of the core assembly for flow through the tubes. According to one form of the invention, shell abutments are engaged by the spaced headers to restrain the core assembly from relative longitudinal displacement and to restrain the headers from a relative separating motion. Also, rigid interponent means, other than the tubes, extends between the headers and prevents their relative approaching motion. In another invention form the headers have a screw threaded engagement with the shell. In both forms, there is freedom of access to and removal of the core assembly while the tubes are relieved of the burden of sustaining of fluid pressures applied through the headers.

An object of the invention is to provide a pressure protected tubular heat exchanger substantially as above set forth.

Other objects and structural details of the invention will appear from the following description when read in connection with the accompanying drawings, wherein.

Figure 1:
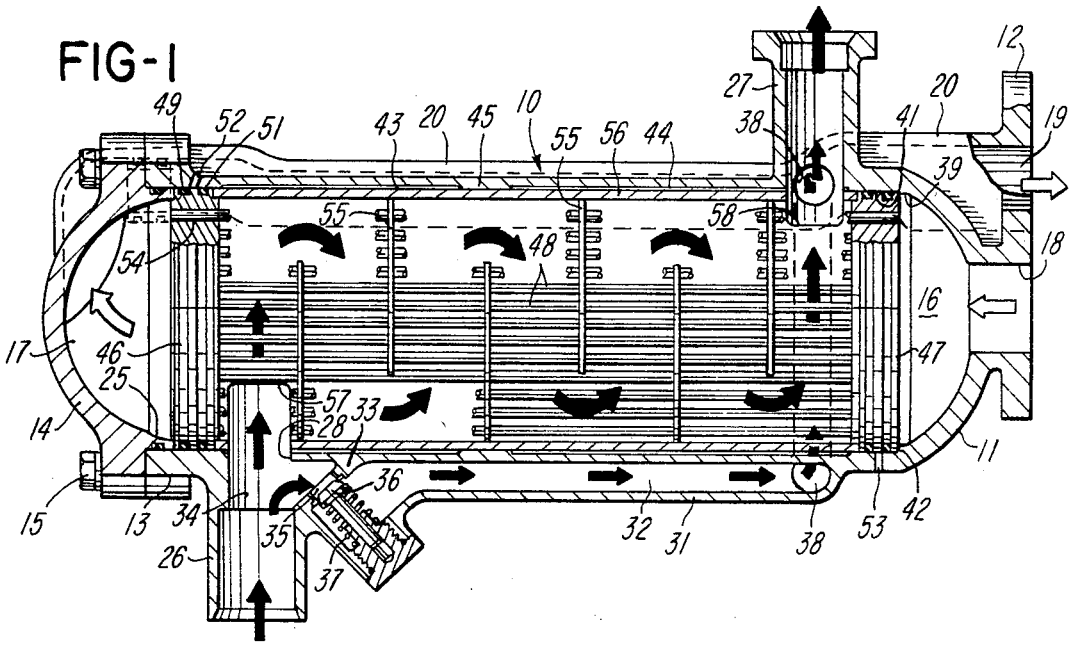
FIG. 1 is a view in longitudinal section of a tubular heat exchanger in accordance with a first illustrated form of the invention.
Figure 2:
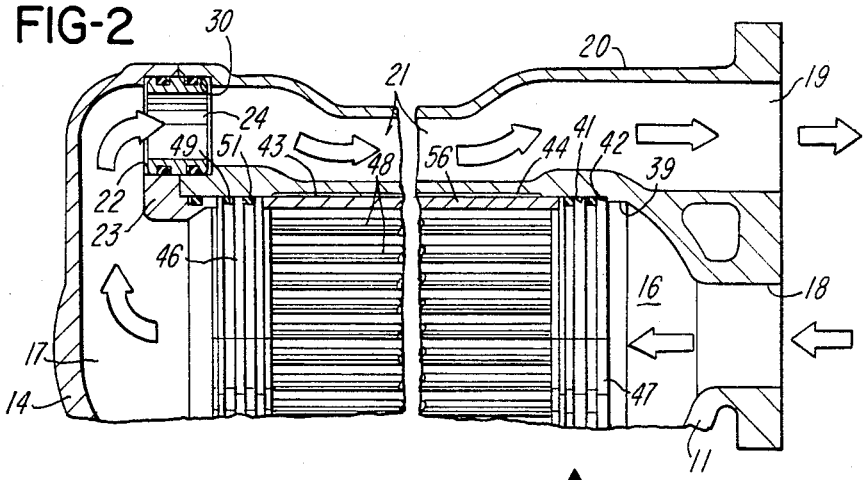
FIG. 2 is a fragmentary view like FIG. 1 showing a return flow route for the tube side fluid.

Referring to the invention embodiment of FIGS. 1 and 2, a tube and shell heat exchanger as here illustrated includes a shell body 10 of elongate generally cylindrical form. At its one end is a manifold extension portion 11 terminating in a flange 12. At its opposite end is a projecting annulus 13 to which a closure member 14 is detachably affixed, as by bolts 15. The extension portion 11 and the closure member 14 have bulbous formations providing at opposite ends of the shell interior manifold chambers 16 and 17.

Opening through the flange 12 is an inlet 18 for admitting a flowing first fluid to manifold chamber 16. In a radially offset relation to inlet 18 is an opening 19 serving as an outlet for the flowing first fluid. Outlet 19 marks the terminus, as shown in FIG. 2, of an elongate, longitudinal passage 21 in a wall 20 of the shell body. An entrance end of the passage communicates through a closure member aperture 22, with manifold chamber 17. Flowing first fluid, admitted to the shell at inlet 18, travels to manifold chamber 17. There it has access to aperture 22 and in a return flow by way of passage 21 exits the shell by way of outlet 19.

The wall 20, in which passage 21 is formed, terminates at an end opposite outlet 19 in a radial expansion of body annulus 13. There it has an interfitting relation with an interior wall portion 23 of closure member 14. A counterbore 30 in wall 20 provides a seat for a spool 24 which bridges and seals the abutting joint between wall 20 and portion 23. Closure member wall portion 23 is a part of an inwardly projecting cylindrical portion 25 received relatively closely within shell body annulus 13. Entrance of projecting portion 25 into annulus 13 is limited by inter-engagement of the annulus extremity with a peripheral flange portion of the closure member. Such abutment is established and maintained by installation and tightening down of the bolts 15.

The shell body may advantageously be formed as an investment casting and includes laterally projecting bosses 26 and 27 for the inlet and outlet of a second flowing fluid. The bosses are stationed near opposite ends of the body and align with respective apertures 28 and 29 in the body wall. The shell is configured to provide an outer wall 31 forming an elongate by-pass passage 32. An interior wall 33 separates passage 32 from a manifold chamber 34 through which boss 26 supplies aperture 28. An opening 35 in wall 33 is controlled by a poppet valve 36 urged by a compression spring 37 to a seat on wall 33 closing opening 35. At its opposite end passage 32 is connected by an arcuate wall passage to the interior of outlet boss 27. Opening 35, through which the flowing second fluid may have access to by-pass passage 32, is normally closed by valve 36. The flowing second fluid accordingly normally enters the shell at aperture 28, moves longitudinally through the shell interior and exits the shell at aperture 29 and boss 27. Should the fluid pressure in inlet manifold 34 rise to a value sufficient to overcome spring 37, valve 36 opens and at least some portion of the flowing second fluid is allowed to reach outlet boss 27, by way of passages 32 and 38 in by-passing relation to the shell interior.

The shell body 10 has a long internal bore 39 terminating in shell extension portion 11 in a bulbous wall forming the chamber 16. An elongate counterbore 41 terminates in an annular abutment 42 at or adjacent to chamber 16. Longitudinally spaced apart annular recesses 43 and 44 in the body interior define an intermediate land 45.

A core unit comprised principally of spaced apart headers 46 and 47 and of interconnecting tubes 48 is received in the shell body 10. The headers are plate-like members configured to conform approximately to internal dimensions of the shell body. More particularly, header peripheries have a relatively close yet sliding contact with the shell interior as defined by counterbore 41. The headers are circumferentially grooved to receive longitudinally spaced apart O-rings 49 and 51 (note header 46 for example) which make sealing contact with counterbore 41. A bleed aperture 52, in the case of header 46, and a bleed aperture 53, in the case of header 47, vent the space between respective sets of O-rings.

The headers have a multiplicity of through tube accommodating holes 54. Tubes 48 extend between the headers and have their ends received in holes 54. By mechanical or by metallurgical means, tube ends are fixed within the headers in a manner to define both a bond and a seal. The tubes are thin walled members adapted for an efficient exchange of heat between a fluid flowing through the tubes and another fluid flowing over and around the tubes. The tubes may be constructed to promote a turbulent fluid flow and thereby a more efficient use of the heat transfer surface.

Further comprised in the core unit are apertured, segmental baffles 55. These are longitudinaly and circumferentially offset from one another in what may be regarded as the tube bundle. By reason of the apertures therein, through which tubes 48 pass, the baffles and tubes are in a mutually supporting relation. In addition, the baffles 55 enforce a circuituous path of flow over the tube bundle.

Finally, the core unit comprises a rigid cylinder 56 surrounding the tube bundle. Opposite ends of the cylinder 56 abut inner faces of the headers 46 and 47. Peripheral cuts in the headers provide for an interfitting engagement of the cylinder with the headers and for a locating of the cylinder periphery as a continuing part of the header peripheries. The cylinder 56 is integrated into the core unit as a part of the assembly process, and all parts of the assembly may be united in a brazing or like process.

With end closure 14 removed, a previously assembled core unit can be inserted into the shell body with the header peripheries and cylinder 56 having a sliding contact with bore 41. This introducing motion is continued until header 47 seats to abutment 42.

Spool 24 may then be inserted in counterbore 30 and end closure 14 applied to and bolted to the shell body. In the process, annular extension 25 engages header 46 and applies an end thrust urging the core unit firmly to a seat on abutment 42.

The core unit accordingly is held tightly between fixed abutments 25 and 42. Longitudinal displacement of the core unit is precluded, as is a relative separating motion of the headers. At the same time, cylinder 56 acts as a rigid bridge between the headers, precluding their relative approaching motion. While made secure within the shell, however, the core unit is readily removable (following removal of the end closure 14) for inspection and servicing. The recesses 43 and 44 facilitate sliding movements of the core unit within the shell body, while land 45 inhibits a by-passing flow around cylinder 56.

As the core unit positions within the shell, an outer face of header 47 is exposed to incoming first fluid in manifold chamber 16. That fluid distributes itself in chamber 16, flows longitudinally through the tubes 48 and discharges into chamber 17 at the opposite end of the shell. From chamber 17, the said first fluid finds its way, as has been seen, by way of spool 24 and return flow passage 21 back to mounting flange 12 and outlet 19 therein. The headers 46 and 47 embrace inlet 28 and outlet 29 for the described second fluid. That fluid accordingly normally enters the core unit at inlet 28, and, as guided by baffles 55, moves in serpentine fashion across and longitudinally of the tube bundle to outlet 29. The cylinder 56 has apertures 57 and 58 which align respectively with inlet 28 and outlet 29.

In a contemplated use or application of the disclosed heat exchanger, the said first fluid entering inlet 18 and leaving outlet 19 is flowing fuel functioning for present purposes as a coolant. The said second fluid entering inlet 28 and leaving outlet 29 is a lubricating or other oil in need of cooling. In some instances, either the fuel or the oil, or both, may arrive at the heat exchanger under relatively high pressure. Fuel pressure as applied in chambers 16 and 17 urges headers 46 and 47 in a relative approaching motion. Oil pressure as applied in the core interior urges the headers in a relative separating motion. Cylinder 56 absorbs pressures urging the headers in an approaching sense. Shell abutments 25 and 42 absorb pressures urging the headers n a separating sense. The integrity of tube to header joints, that is, the connection of the tubes 48 to the headers within holes 54, accordingly is protected. Further, since the tubes 48 are not under longitudinal compression there is no possibility of their columnar strength being exceeded by high or surge-like pressures in the manifold chambers 16 and 17.

Figure 3:
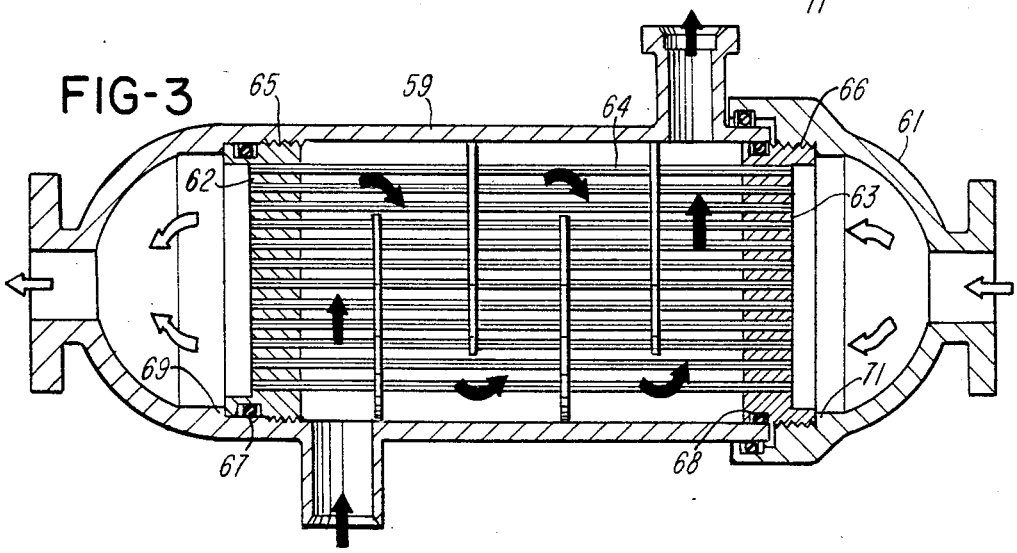
FIG. 3 is a view like FIG. 1, showing a second illustrated form of the invention.

In a form of the invention as shown in FIG. 3, a tubular heat exchanger comprises a shell or body 59 one end of which is closed by a removable cap 61. A core assembly including headers 62 and 63 and interconnecting tubes 64 is received within the body 59. The headers are externally threaded to mate with internal screw thread locations 65 and 66 in the body 59 and cap 61 respectively. The header peripheries may include respective seals 67 and 68, and the body and the cap respective abutment portions 69 and 71.

The core assembly is introduced into the open end of the body and rotated into screw threaded engagement with thread 65, such motion being continued until header 62 seats or substantially seats to abutment 69. Cap 61 is then applied and rotated into threaded engagement with header 63 until abutment 71 seats or substantially seats to the header. The headers are effectively held against relative approaching and separating motions, by means other than the tubes 64.

Provision is made for fluid flow through the device of FIG. 3, substantially as in FIGS. 1 and 2. In this instance, however, the tube side fluid, that is, the fluid flowing through the tubes is for convenience shown as directly exiting the body through an opening 72 in the closed end thereof.

Particular invention embodiments have been disclosed for illustration purposes. It will be evident that modification within the skill of those versed in the art may be made without departing from invention concepts.

What is claimed is:

1. A heat exchanger of the tube and shell type, including a heat exchange core comprising spaced apart headers and interconnecting tubes, said tubes being attached to said headers, and a shell receiving said core, said shell having an inlet and an outlet for a first fluid and directing said first fluid to flow between the core headers over and around said tubes, a second fluid being directed to the external face of one of said headers for flow through said tubes, at least one of said fluids being under relatively high pressure, said core having an unbonded separable relation to said shell for unitary simplified core installation and removal, and means independent of said tubes for absorbing fluid pressure induced forces tending to effect relative separating and approaching motions of said headers.

2. A heat exchanger according to claim 1, said headers defining inner and outer core ends with regard to an open end of said shell through which said core is introduced and withdrawn, said shell providing an abutment to seat the header at the inner core end and including a removable closure for said open end thereof providing an abutment to seat to the header at the outer core end, said core being restrained by said abutments against relative endwise motion in the shell and said headers being restrained thereby against relative separating motion, and means between said headers other than said tubes restraining said headers against relative approaching motion.

3. A heat exchanger according to claim 2, said last named means comprising rigid interponent means abutting at its opposite ends respective interior faces of said headers.

4. A heat exchanger according to claim 3, said rigid interponent means having the character of a cylinder surrounding the assembly of tubes interconnecting said headers.

5. A heat exchanger according to claim 1, said shell being an assembled part comprising a body open at least at one end and a removable closure cap for said open end, said shell providing spaced apart interior screw thread locations and said headers being peripherally threaded positively to engage with the shell at said locations.

6. A heat exchanger according to claim 5, one of said spaced apart screw thread locations being in said closure cap.

7. A heat exchanger according to claim 6, said body and said closure cap being formed with abutment means limiting relative separating motion of said headers.

* * * * *